US005251900A

United States Patent [19]

Gallant

[11] Patent Number: 5,251,900

[45] Date of Patent: Oct. 12, 1993

[54] THREE-DIMENSIONAL PUZZLE STRUCTURE

[76] Inventor: Paul Gallant, 568, de Beaucaire, Laval-des-Rapides, Canada, H7N 4P3

[21] Appl. No.: 901,695

[22] Filed: Jun. 22, 1992

[30] Foreign Application Priority Data

Sep. 9, 1991 [CA] Canada ..... 2050969

[51] Int. Cl.[5] ..... A63F 9/12

[52] U.S. Cl. ..... 273/157 R; 273/160

[58] Field of Search ..... 273/157 R, 156, 160

[56] References Cited

U.S. PATENT DOCUMENTS

| | | |
|---|---|---|
| 294,589 | 3/1884 | Crandall . |
| 1,964,007 | 6/1934 | Parks . |
| 2,569,107 | 9/1951 | Johnson . |
| 2,825,568 | 3/1958 | Birsh . |
| 2,987,318 | 6/1961 | Hammer . |
| 3,137,967 | 6/1964 | Flieth . |
| 3,485,496 | 12/1969 | Brunton . |
| 3,701,214 | 10/1972 | Sakamoto . |
| 4,824,112 | 4/1989 | Roy . |

FOREIGN PATENT DOCUMENTS

| | | |
|---|---|---|
| 3314496A1 | 10/1984 | Fed. Rep. of Germany . |
| 2177929A | 2/1987 | United Kingdom . |

*Primary Examiner*—V. Millin
*Assistant Examiner*—Raleigh W. Chiu
*Attorney, Agent, or Firm*—Pierre Lespérance; Francois Martineau

[57] ABSTRACT

A puzzle formed of a plurality of puzzle pieces which, when assembled, create a self-standing, three-dimensional building structure. The puzzle pieces are of irregular, polygonal shape, but all puzzle pieces are flat, planar blocks. The blocks are releasably interlocked about a common plane with first, edgewise, complementary dovetail joints. For interlocking puzzle walls that are transverse to one another, second, straight U-shape, edgewise, complementary tenon and mortise joints are further provided edgewisely of those corner blocks for frictional interlocking. Thus, no separate pin, bent units or the like are required to anchor the corner portions of the three dimensional structure. The self-standing, enclosing structure is continuous, and show a continuous image on its external face.

5 Claims, 7 Drawing Sheets

THREE-DIMENSIONAL PUZZLE STRUCTURE

FIELD OF THE INVENTION

The invention relates to puzzle pieces that can be assembled as a three dimensional, self-standing structure.

BACKGROUND OF THE INVENTION

A puzzle is a toy that tries the ingenuity and taxes the patience of a player. A puzzle game usually involves the selection and sequential assembly of a plurality of polygonal sheet pieces of varying contour, to recreate an original image about a flat sheet board. More complex puzzle games include assembling a three-dimensional self-standing structure with a variety of puzzle pieces, along edgewisely interlocked horizontal and vertical walls.

An example of the latter type of three dimensional puzzle can be found in the recent U.S. Pat. No. 4,824,112 issued in April 1989 to Roy. An inconvenience with such a puzzle is that non-planar puzzle pieces have to be used, more particularly at the corners of two transverse walls of the self-standing assembled structure—see FIG. 7*a* of the Roy reference. This means that two different dies are required for the manufacture of the puzzle pieces: one for the flat, planar pieces, and another for the bent corner pieces. This is inefficient.

Other three-dimensional puzzles rely for their self-standing capability onto locking pins or the like, for anchoring the corner edge portions of pairs of transverse walls forming part of the puzzle. This can be found in U.S. Pat. No. 2,569,107 to Johnson. Again, this requires additional particular means distinct from the puzzle pieces as such, a manufacturing inefficiency.

A three-dimensional, self-standing puzzle structure made exclusively of planar puzzle pieces, is disclosed in U.S. Pat. No. 3,701,214 issued in 1972 to the Kyoikushuppan Co of Japan (kyoi'). In this patent, each puzzle piece is a flat polygonal block having dovetail joints at its edgewise sections for interlocking engagement with complementary, edgewise, dovetail joints of adjacent puzzle pieces. Adjacent blocks are interlocked by engagement of mating, male and female, complementary dovetail joint elements.

The Kyoi' patent is interesting, however, it must be quite difficult to assemble the corner parts of the self-standing structure, if each wall is made from a number of puzzle pieces, since the dovetail male element of a first block cannot by definition engage the dovetail female element of a second block within the plane of any of these two blocks. More particularly, as is well known in the art, to interlock male and female dovetail joint elements, they must first be brought in transverse register with one another, and then inserted sidewisely through their planes. The male dovetail element certainly cannot be inserted head on through the mouth of the female dovetail element.

Hence, it is not seen how a complete, enclosed, self standing, continuous, three dimensional structure could be made with the Kyoi' puzzle pieces, where each wall is constituted by more than one puzzle piece. Indeed, the Kyoi' patent would probably enable erection of a building structure having two or three, multiple puzzle piece walls, but a fourth and last wall of the building structure enclosing same could not in fact be installed to the two opposite side walls, because the dovetail joints interlocking axis would prevent positioning of the fourth wall edgewisely against the two side walls.

FIG. 8 of the Kyoi' patent suggests that an enclosed, albeit discontinuous structure could be constructed with the dovetail joint puzzle pieces thereof. However, for this to occur, each wall of the structure must consist of a single puzzle piece, as illustrated in the figure. Having a self-standing structure with a single modular unit for each wall is not considered by applicant to constitute a true puzzle. In any event, the image from FIG. 8 of the Kyoi' patent is discontinuous at the corner edges thereof.

OBJECTS OF THE INVENTION

The gist of the invention is therefore to provide a three-dimensional, self-standing, puzzle game, in which all puzzle pieces are made from flat sheet material and in which the erected puzzle structure forms a continuous enclosure.

A corollary object of the invention is to reduce the manufacturing costs of three-dimensional puzzle games.

SUMMARY OF THE INVENTION

Accordingly with the objects of the invention, there is disclosed a modular unit for use in a three dimensional, self-standing, continuous puzzle structure, consisting of a planar, polygonal block defining first and second, opposite, main, flat faces, and a peripheral edge joining said first and second faces orthogonally relative thereto, at least one of said first and second faces forming an image destined to face externally of said puzzle structure; said block edge comprising: (a) first, dovetail joint means, for releasably anchoring complementary dovetail joint means of a second block edgewisely of the first-mentioned block within the plane of the second block; and (b) second, straight tenon and mortise joint means, for frictionally securing complementary tenon and mortise joint means of a third block edgewisely of the first-mentioned block within a plane substantially orthogonal to the third block; wherein said second joint means is characterized in that it specifically allows assemblage of a number of walls each made from a plurality of said modular units, and erection of a puzzle structure having a continuous external surface circumscribing an enclosure.

Preferably, third, straight tenon and mortise joint means are provided, for frictionally securing a pair of complementary tenon and mortise joint means from fourth and fifth blocks edgewisely of the first-mentioned block, the fourth block being orthogonal to the first block and the fifth block being orthogonal to both the first-mentioned block and the fourth block; wherein an image is formed on both said first and second faces of the first mentioned block.

Advantageously, said block is made from a main, semi-rigid, resilient foam backing, and there is further included a colour film sheet layer into which said image is embedded, said colour film sheet layer being glued to the face of said foam destined to face externally of the puzzle structure.

Alternately, the invention also consists of the combination of a number of first and second modular units releasably interlocked with one another to form a three dimensional, continuous puzzle, each modular unit consisting of a planar, polygonal block defining first and second, opposite, main, flat faces, and a peripheral edge joining said first and second faces orthogonally relative thereto, at least one of said first and second faces of each block forming a small image which, combined with the images from corresponding faces of the other said blocks, form a continuous main image; each said block edge from each one of said first and second modular units comprising: (a) first dovetail joint means, releasably anchoring complementary joint means from a second said block edgewisely of the first mentioned block within the plane of the latter block; and each said block edge from each one of said second modular units further comprising: (b) second, straight tenon and mortise joint means, frictionally securing complementary joint means from a third block edgewisely of the first mentioned block within a plane substantially orthogonal to the latter block; wherein said second joint means is characterized in that it specifically allows assemblage of a number of walls each made of a plurality of said modular units, and erection of a puzzle structure having a continuous external surface circumscribing an enclosure.

Preferably then, in its assembled state, said puzzle forms a building structure defining a horizontal bottom base wall and vertical side walls interlocked with and edgewisely projecting from said base wall, the said enclosure being defined between said vertical side walls; and further including a large, cardboard-based roofing sheet, installed over the top edge defined by said vertical side walls, and means are provided for self-support of said roofing sheet thereon.

DETAILED DESCRIPTION OF THE INVENTION

Figure 1:
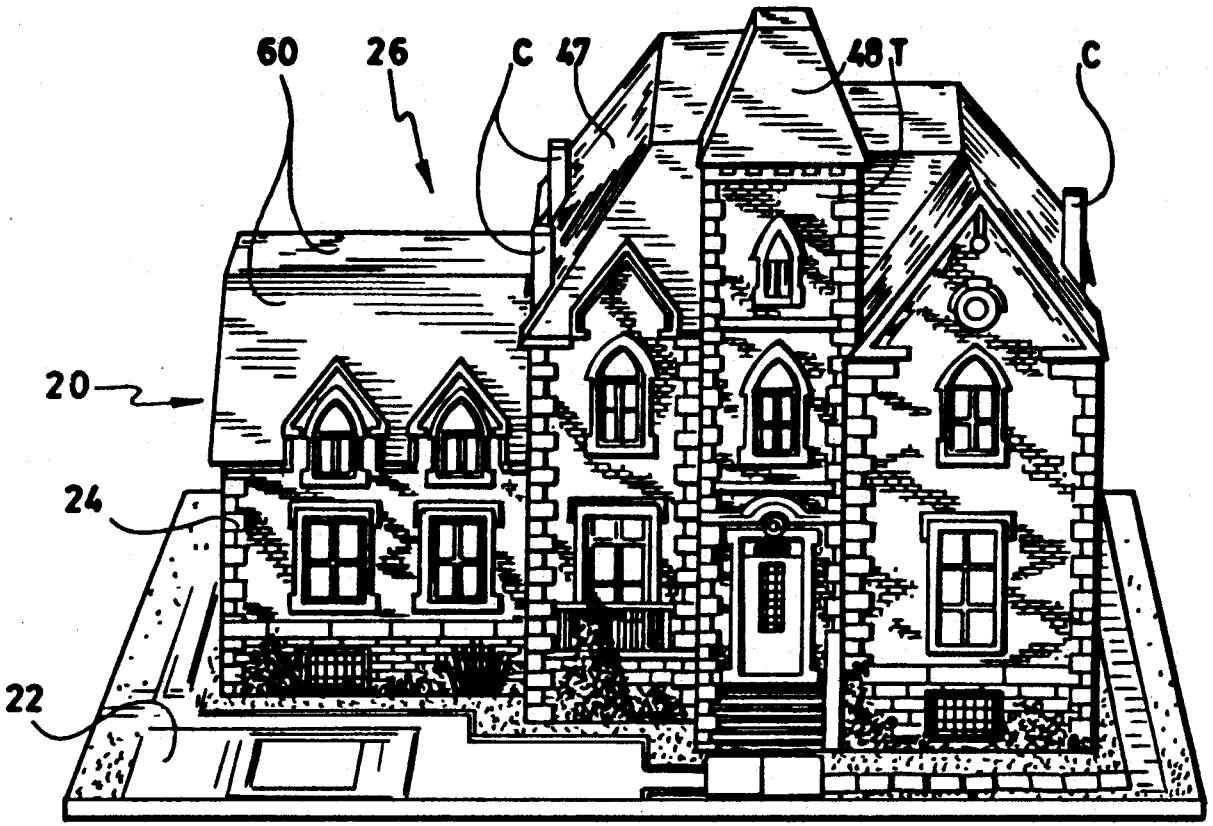
FIG. 1 is an isometric view of the three-dimensional (3D) puzzle of the invention.
Figure 2:
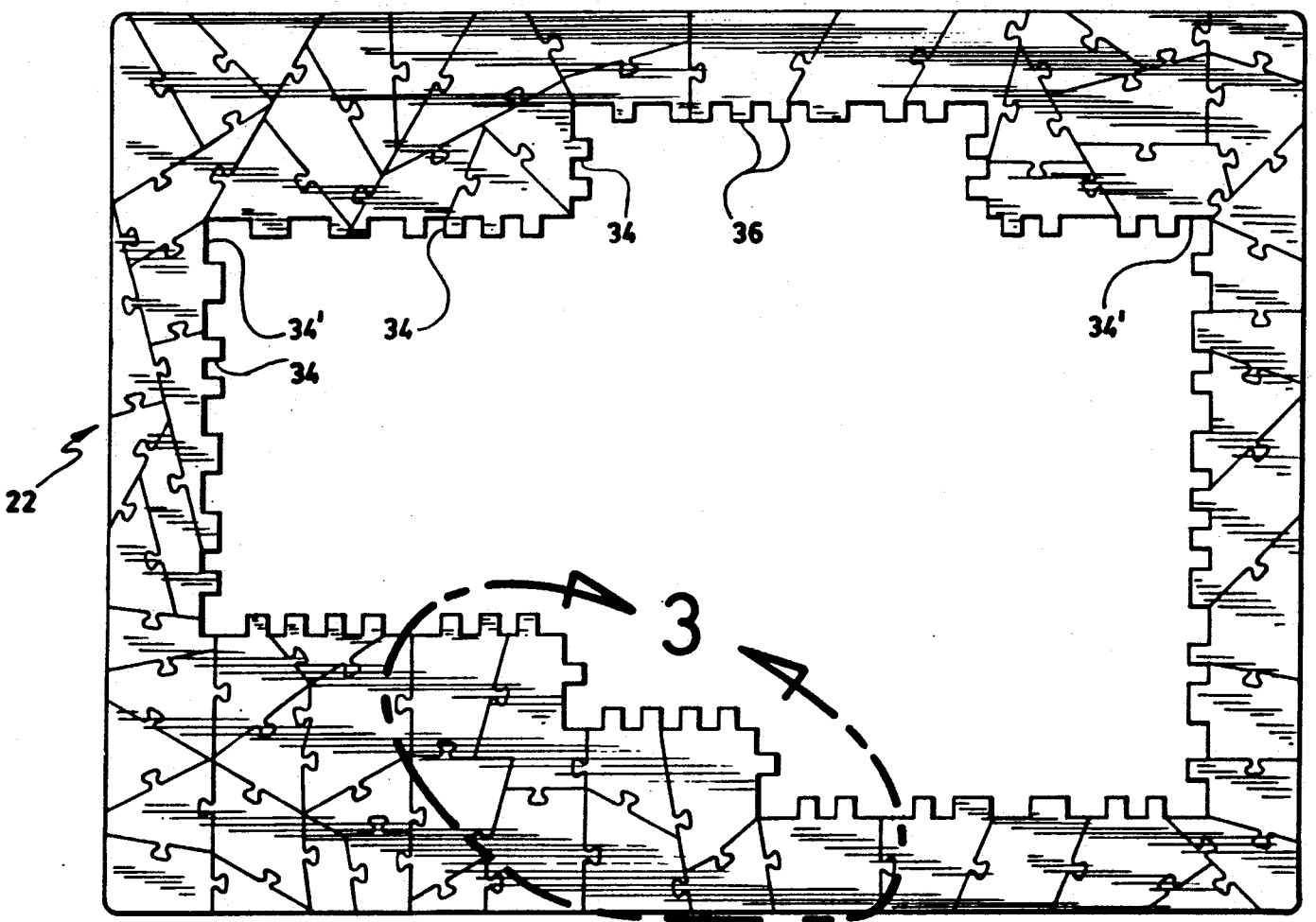
FIG. 2 is an enlarged plan view of the ground level part of the 3D puzzle.

A preferred embodiment of the three dimensional, self-standing puzzle is illustrated at 20 in FIG. 1. 3-D puzzle 20 has the shape of a small castle, but could have any other configuration, of course. Castle 20 generally defines a horizontal ground level 22, upright walls 24 upwardly depending edgewisely from the ground base 22, and an inclined roofing 26 supported by the top edges of upstanding walls 24.

Figure 3:
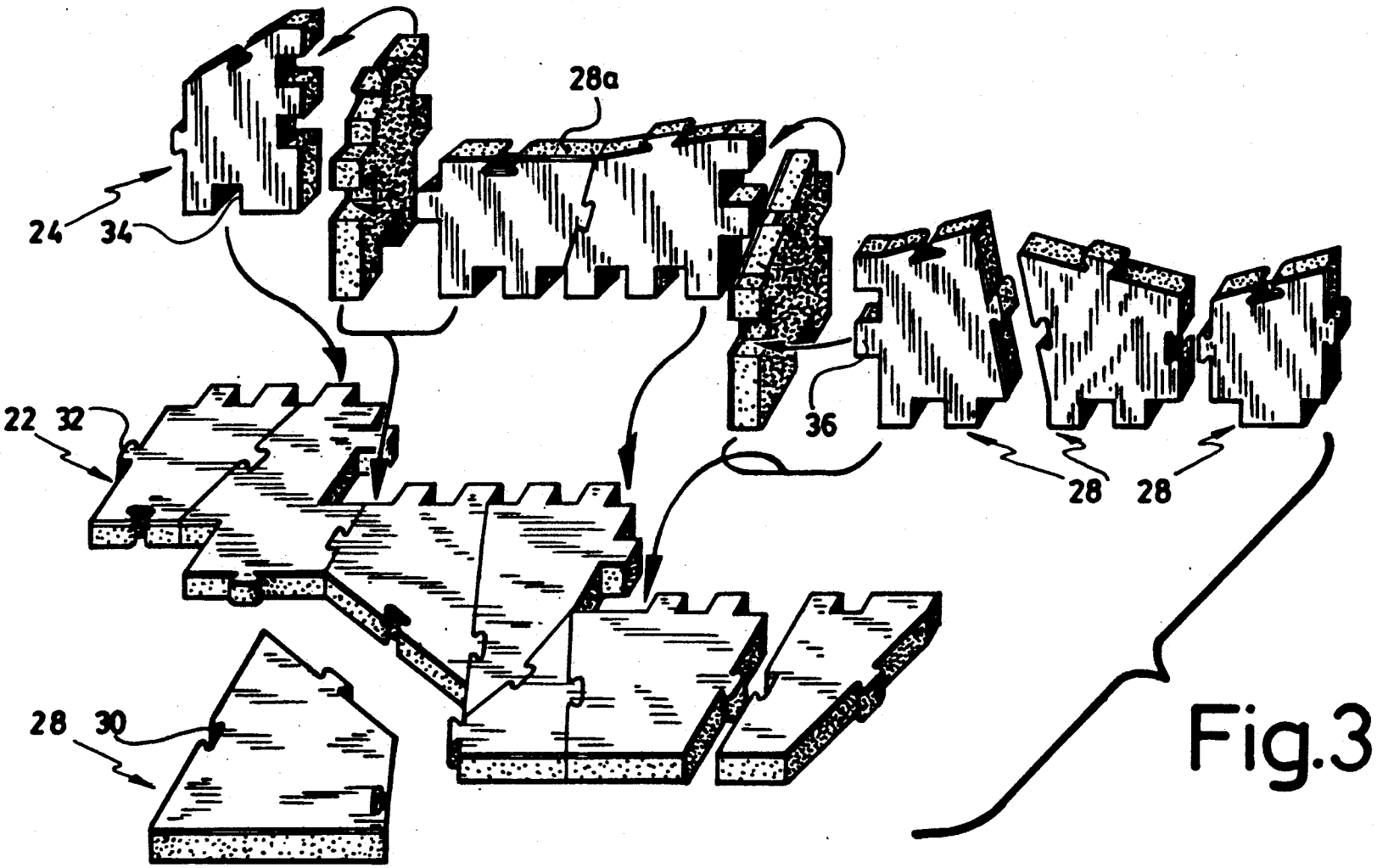
FIG. 3 is an exploded view at an enlarged scale of the modular building blocks of the 3D puzzle, suggesting how a few vertical building blocks can transversely fit onto the horizontal base of FIG. 2.
Figure 5:
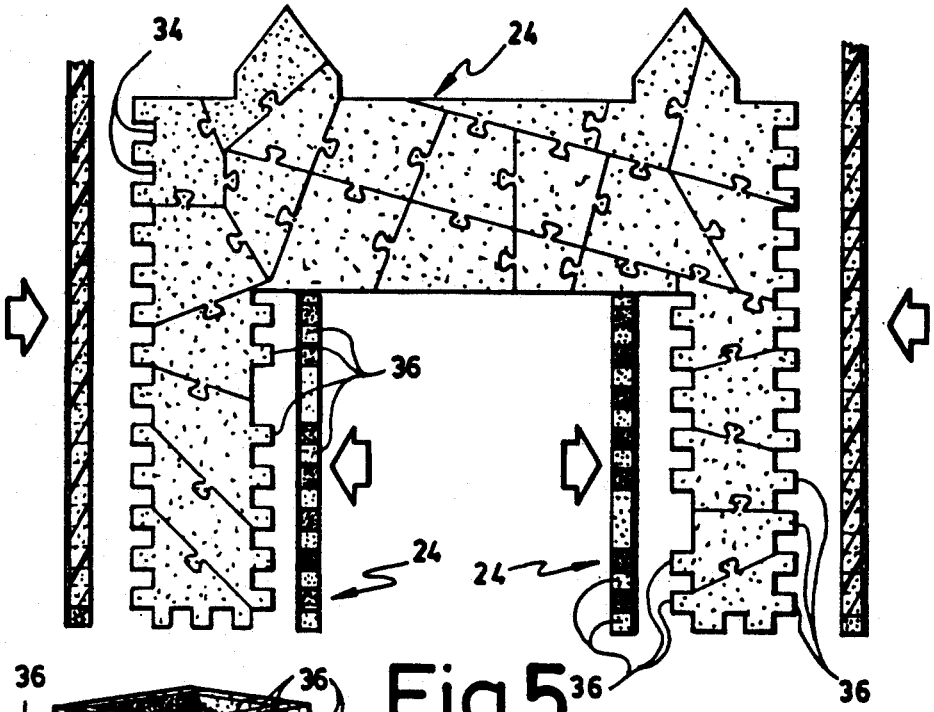
FIGS. 5–6 are sectional views along lines 5—5 and 6—6 of FIG. 4, respectively.
Figure 11:
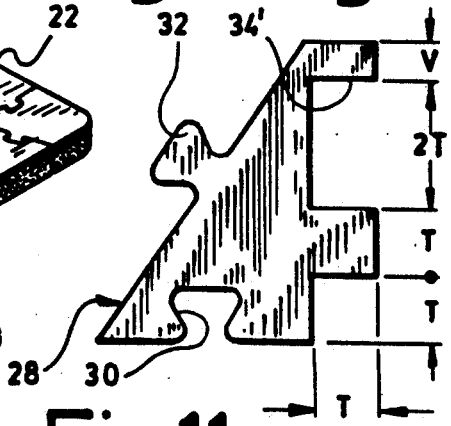
FIG. 11 is a plan view of a third embodiment of modular building block.
Figure 12:
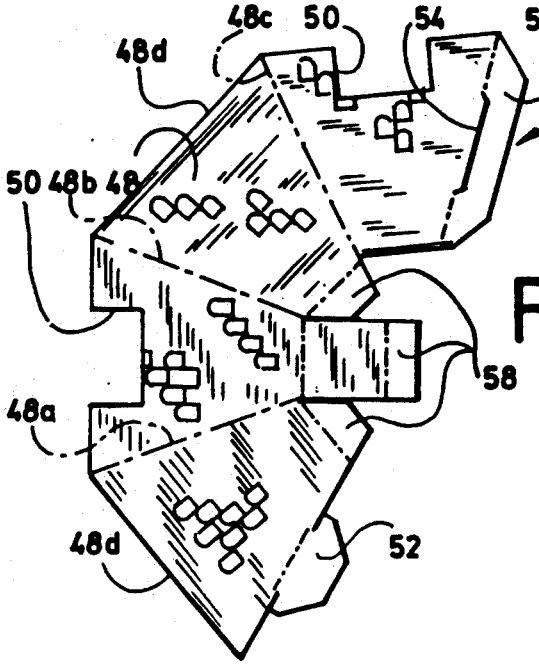
FIG. 12 is a plan view of a tower part of the roofing for the 3D puzzle castle of FIG. 1.

Puzzle 20 consists of a plurality of releasably interlocked puzzle pieces 28, as best illustrated in FIGS. 3, 5 and 11. Puzzle pieces 28 constitute polygonal sheets forming modular building blocks or units of variable shape, accordingly with their relative position and function in the puzzle 20. However, the puzzle blocks 28 have common features constituting the heart of the invention. These features are as follows:

(a) each puzzle block 28 is completely flat and planar;

(b) within a planar surface, e.g. about base 22 or wall 24, the interlocking joint between each pair of adjacent puzzle block is of the dovetail type, defining complementary female part 30 and male part 32. As best shown in FIG. 11, the corner edges of male part 32 are preferably smooth and rounded;

(c) at the marginal or corner portions of two adjacent planar surfaces, e.g. at the intersection of base 22 and upright wall 24, the transverse interlocking joint between each pair of adjacent puzzle block 28 which are transverse to each other, is of the straight U mortise and tenon type, defining a U-shape mortise part 34 and a quadrangular tenon part 36. Some mortise parts 34' are wider (FIG. 11), to accommodate two tenon parts 36, 36 from two additional blocks 28, 28 as detailed hereinbelow;

(d) each puzzle block 28 consists of a main semi-rigid backing layer 38, defining two opposite main faces 38*a*, 38*b*. Backing 38 is preferably made from compressible, resilient foam. At least one face 38*a*, 38*b* and where appropriate both main faces 38*a*, 38*b* (see below) bear an additional film layer 40, 42 glued to foam backing 38, see FIGS. 9–9*a;*

Figure 4:
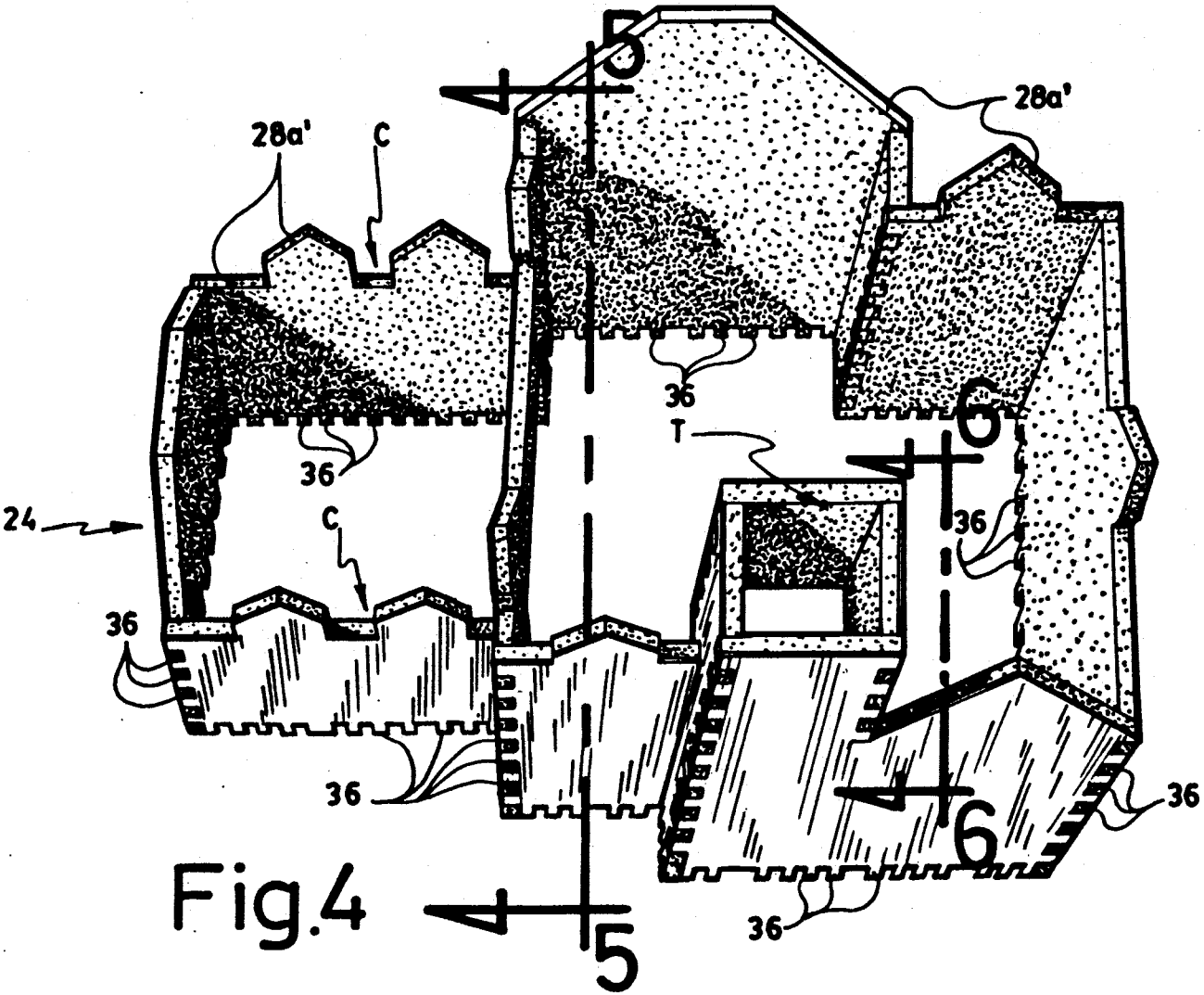
FIG. 4 is a perspective view of an intermediate section of the 3D puzzle, illustrating the vertical walls thereof.

(e) the side edges 28*a* thereof join the two opposite main faces thereof at 38*a*, 38*b*, and are flat and orthogonal to these two main faces, although they may be of irregular height, see particularly FIG. 4.

It is clear that the dovetail joints 30, 32 which interlock each pair of adjacent coplanar building blocks 28, require for their release relative displacement of these blocks 28 transversely through their common plane. In other words, once blocks 28 are interlocked in a horizontal plane (base 22), each horizontal block 28 needs to be pulled upwardly, that is transversely from the horizontal plane, for its release from an adjacent horizontal block; and once blocks 28 are interlocked in a vertical plane (wall 24), each vertical block 28 needs to be pushed horizontally—transversely from its vertical plane—for its release from an adjacent vertical block 28.

Figure 7:
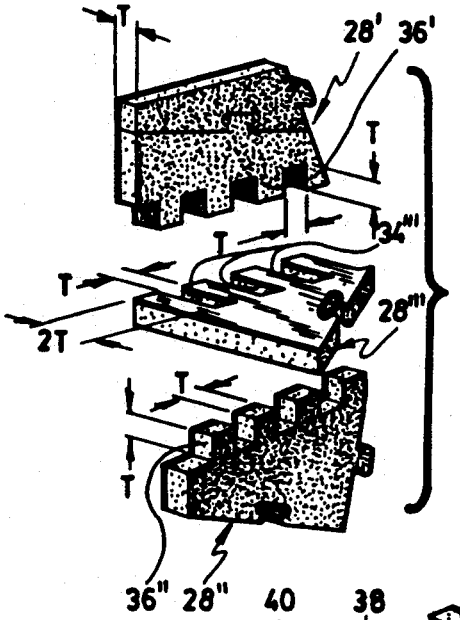
FIG. 7 is an exploded view of the three modular building blocks, showing both edgewise dovetail joints and U-tenon and mortise joints.
Figure 8:
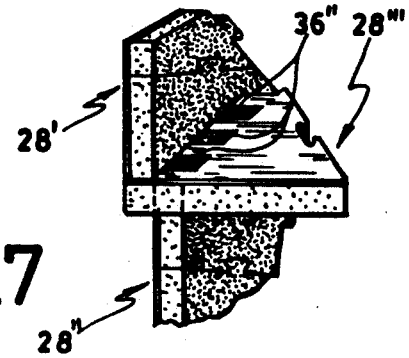
FIG. 8 shows in perspective view the three modular units of FIG. 7 in assembled condition.

The innovative features lie in the corner joints—FIGS. 7–8—where the straight (U-shape) mortise and tenon parts 34, 36 intervene to join two building blocks 28, 28 about two planes transverse to each other. Since the corner joints 34, 36 interlock modular units 28, 28 about transverse, preferably orthogonal planes, there is always a vertical wall edgewisely sitting against a substantially horizontal wall. This biases the straight mortise and tenon joint 34, 36 in interlocking state, under the bias of the vertical wall weight. And when release of the straight mortise and tenon joint 34, 36 is required, one needs only to pull a first building block 28 away from the adjacent transverse, second block, within the plane of the first block, to release the tenon from the mortise. To prevent accidental lateral release of the tenon 36 from its mating mortise 36, the dimensions of the former should be only very slightly smaller than that of the latter, whereby friction fit engagement is obtained.

It is understood that such straight joints 34, 36 will enable erecting a building with its upright walls defining a continuous enclosure, i.e. that the lateral upright walls of the building can be interlocked in a continuous fashion around a closed inner chamber. In other words, straight joints 34, 36, will allow installation of all of the side walls, including the last side wall which closes the enclosure.

The reader will recall from the prior art paragraph that U.S. Pat. No. 3,701,214 to Sakamoto had puzzle pieces being provided with edgewise joints limited to dovetail type complementary interlocking members. As a consequence, the Sakamoto joints would prevent interlocking engagement of the last wall closing the enclosure of the 3D puzzle building, in the case of such a puzzle building having walls each made of a plurality of puzzle pieces. Moreover, the Sakamoto 3D puzzle is discontinuous. The present invention is therefore distinct from the Sakamoto reference.

Some mortise parts 34' can be deeper than the other mortise parts 34, as illustrated in FIG. 7, to enable interlocking of upper and lower vertical blocks 28', 28" onto an intermediate level horizontal block 28'''. That is to say, the tenons 36" of the lower blocks 28" may befit the inner (deeper) side of the deeper mortises 34' of intermediate level block 28''', while the tenons 36' of the upper blocks 28' will then befit the outer (free) side of the mortises 34''' of the intermediate level block 28''', slidingly of adjacent tenons 36", so that blocks 28', 28" become parallel to one another.

Figure 10:
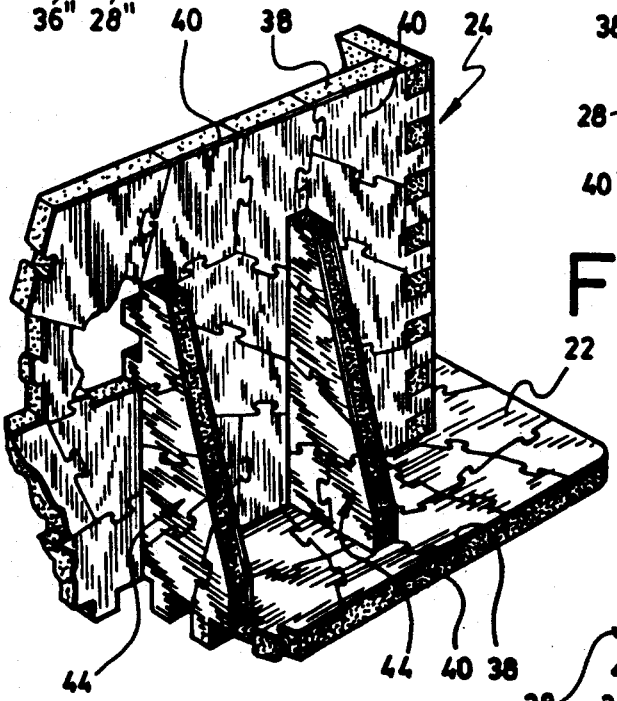
FIG. 10 is a perspective view of simulated ground supported vertical struts or columns for transversely supporting a vertical wall of the 3D puzzle castle of FIG. 1.

Looking now more particularly at FIGS. 10–11, the same can be said to be true for two horizontal blocks having a wider female dovetail cavity 34', for securing an intermediate block, as we will see shortly.

It is understood from FIG. 10 that the image layer 40 of each single image layered block 28 will always be facing outwardly of the castle 20. Of course, there is no point in having that layer facing inwardly, since the owner of puzzle 20 will want to visually appreciate the overall building structure by the combination of the plurality of fragments of images forming an external continuous image with the interlocked blocks 28.

Figures 9, 9A:
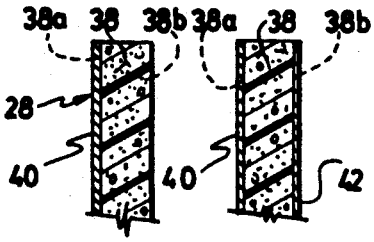
FIGS. 9 and 9*a* show in cross-section two embodiments of modular building blocks respectively with one face and two opposite faces thereof bearing an image film.

Advantageously, upright sheet columns 44 are added, being made to stand on base 22 and to edgewisely abut transversely against the outer face of vertical wall 24. Such exterior sheet columns 44 therefore define two opposite main faces 44*a*, 44*b* which both face exteriorly of the castle 20. Then, such columns 44 would benefit from having image layers 38*a*, 38*b* on both main faces thereof (FIGS. 9*a* and 10).

Figure 6:
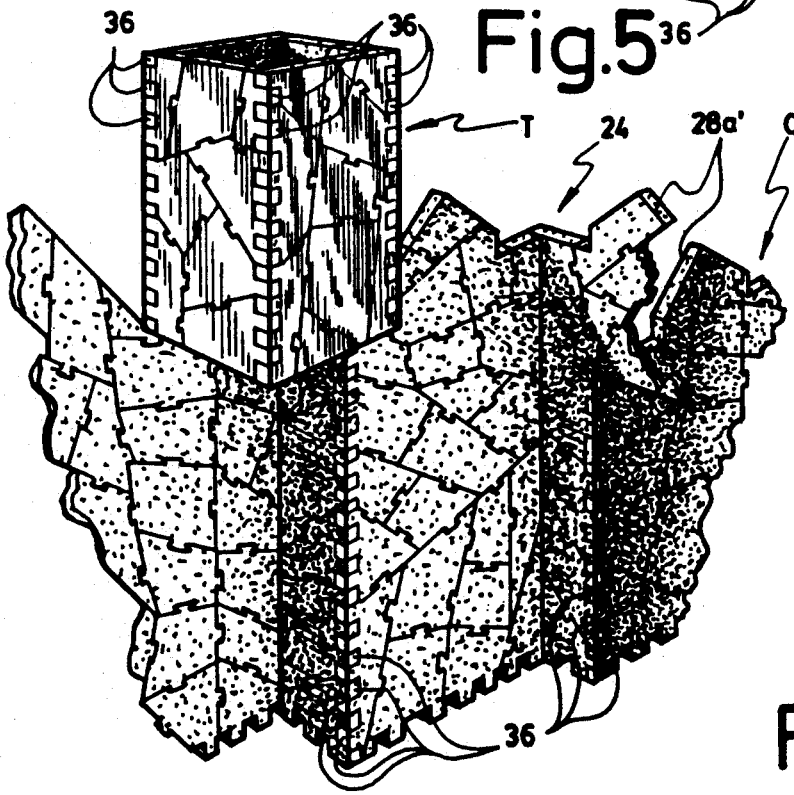
Figure 6A:
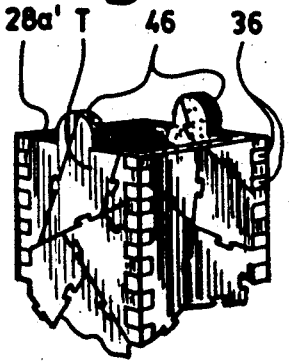
FIG. 6*a* is a broken view of the tower part of the 3D puzzle castle of FIG. 6.
Figure 13:
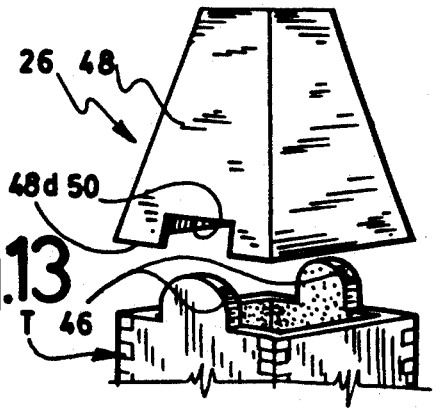
FIGS. 13–14 show in perspective view how the tower roofing from FIG. 12 can be fitted onto the tower of the 3-D castle, by the tenon and mortise joints.
Figure 14:
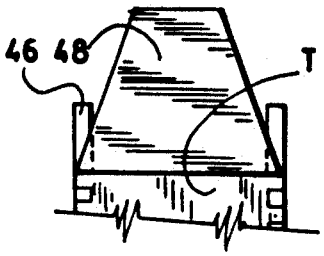

We will now look at the roofing 26 and top edgewise section of the supporting vertical walls 24. Attention is drawn to FIGS. 4–6*a* and 12–16 of the drawings. FIG. 4 clearly shows that while the modular blocks bottom and lateral side edges 28*a* of the 3D puzzle upright walls 24 comprise the joints 30–32 or 34–36, the top edges 28*a*' of the castle vertical walls 24 lack any such joints. However, top edges 28*a*' are of varying heights, to form various simulated architectural figures, e.g. crenels C or towers T for the castle. The tower T can be edgewisely supported by a single side only of the main vertical wall, as suggested in FIG. 6. The top edge of tower T can be completely flat—FIG. 6—or could include semi-circular tenon extensions 46—FIG. 6*a*—wherein the former tower would be open at its top end while the latter tower would engage a roofing part 48 at its top end—FIG. 13.

Various roofing parts 26 are shown in FIGS. 12–16. Each roofing part 26 consists of a thin sheet of semi-rigid material, which is self-supporting onto the top edge 28*a*' of side walls 24. Sheet roof 26 is thinner than walls 22 or 24. In the first embodiment of roofing in FIGS. 12–14, an elongated, flat, cardboard arcuately-disposed, three fold lines 48*a*, 48*b*, 48*c* is bent and closed into a cross-sectionally square box, 48, being opened at its bottom end 48*d*, as suggested in FIG. 13. The bottom edge of box 48 has U-shape cavities 50 for interlocking engagement by semi-circular tenons 46 of tower T. An edge lip 52 engages a slit 54 made in an opposite end flap 56 of the elongated cardboard sheet forming box 48, to maintain the assembled box shape of the tower T. The top end of roof box 48 is closed by a triplet of edgewise flaps 58.

Figure 16:
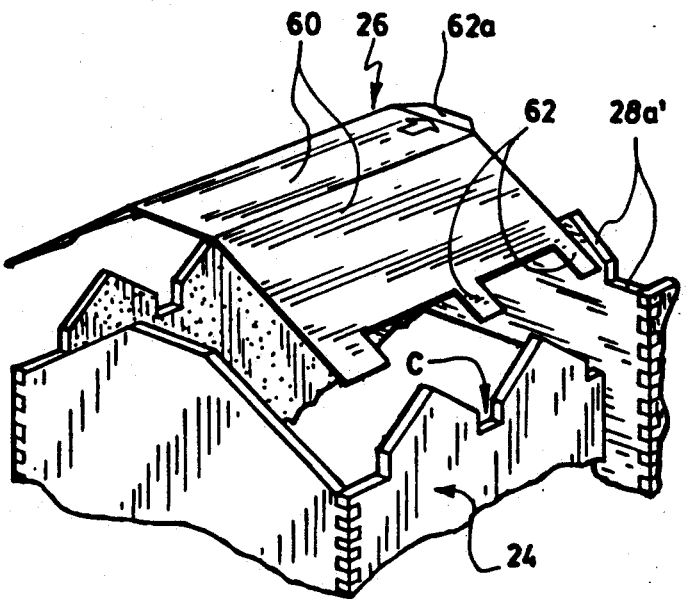
FIG. 16 shows in perspective view how the roofing sheet of FIG. 15 can befit the vertical walls of the 3-D castle of FIG. 1.
Figure 15:
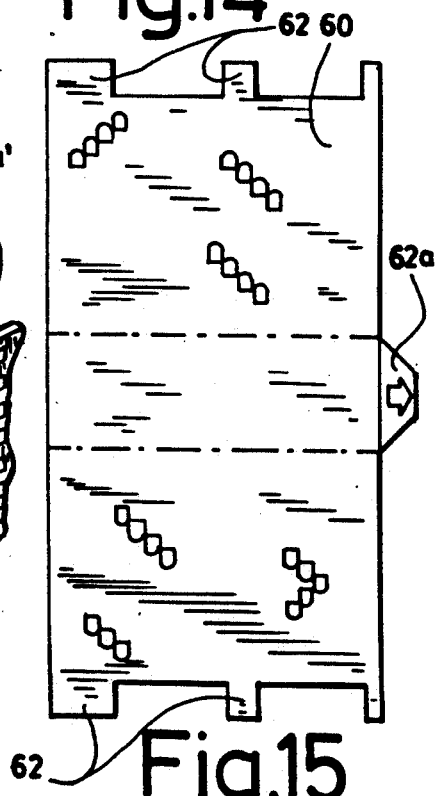
FIG. 15 is a plan view of the main roofing sheet of the 3-D castle.

The second embodiment of roofing is shown as 60 in FIGS. 15–16. Main roofing 60 is a thin rectangular sheet with flat extensions 62 for hookingly engaging the crenels C in interlocking fashion. Roofing part 60 has a ridge lip 62*a* for engaging under the main roof sloping part 47 (FIG. 1).

Each roofing consists of a substantially rigid backing, e.g. cardboard, covered with a single-colour layer.

I claim:

1. A modular unit for use in a three dimensional, self-standing, continuous puzzle structure, consisting of a planar, polygonal block defining first and second, opposite, main, flat faces, and a peripheral edge joining said first and second faces orthogonally relative thereto, at least one of said first and second faces forming an image destined to face externally of said puzzle structure; said block edge comprising:

(a) first, dovetail joint means, for releasably anchoring complementary dovetail joint means of a second block edgewisely of the first-mentioned block within the plane of the second block; and (b) second, straight tenon and mortise joint means, for frictionally securing complementary tenon and mortise joint means of a third block edgewisely of the first-mentioned block within a plane substantially orthogonal to the third block; wherein said second joint means is characterized in that it specifically allows assemblage of a number of walls each made from a plurality of said modular units, and erection of a puzzle structure having a continuous external surface circumscribing an enclosure.

2. A modular unit as defined in claim 1, further including third, straight tenon and mortise joint means, for frictionally securing a pair of complementary tenon and mortise joint means from fourth and fifth blocks edgewisely of the first-mentioned block, the fourth block being orthogonal to the first block and the fifth block being orthogonal to both the first-mentioned block and the fourth block; wherein an image is formed on both said first and second faces of the first mentioned block.

3. A modular unit as defined in claim 1, wherein said block is made from a main, semi-rigid, resilient foam backing, and further including a colour film sheet layer into which said image is embedded, said colour film sheet layer being glued to the face of said foam destined to face externally of the puzzle structure.

4. In combination, a number of first and second modular units releasably interlocked with one another to foam a three dimensional, continuous puzzle, each modular unit consisting of a planar, polygonal block defining first and second, opposite, main, flat faces, and a peripheral edge joining said first and second faces orthogonally relative thereto, at least one of said first and second faces of each block forming a small image which, combined with the images from corresponding faces of the other said blocks, form a continuous main image; each said block edge from each one of said first and second modular units comprising:

(a) first dovetail joint means, releasably anchoring complementary joint means from a second said block edgewisely of the first mentioned block within the plane of the latter block; and each said block edge from each one of said second modular units further comprising:

(b) second, straight tenon and mortise joint means, frictionally securing complementary joint means from a third block edgewisely of the first mentioned block within a plane substantially orthogonal to the latter block;

wherein said second joint means is characterized in that it specifically allows assemblage of a number of walls each made of a plurality of said modular units, and erection of a puzzle structure having a continuous external surface circumscribing an enclosure.

5. A combination as in claim 4, wherein in its assembled state, said puzzle foams a building structure defining a horizontal bottom base wall and vertical side walls interlocked with and edgewisely projecting from said base wall, the said enclosure being defined between said vertical side walls; and further including a large, cardboard-based roofing sheet, installed over the top edge defined by said vertical side walls, and means for self-support of said roofing sheet thereon.

* * * * *